US006550402B1

(12) United States Patent
Stone et al.

(10) Patent No.: US 6,550,402 B1
(45) Date of Patent: Apr. 22, 2003

(54) NESTING TABLE SYSTEM

(76) Inventors: Richard D. Stone, P.O. Box 251, Bennette, CO (US) 80102; Dale B. Stone, P.O. Box 251, Bennette, CO (US) 80102

( * ) Notice: Subject to any disclaimer, the term of this patent is extended or adjusted under 35 U.S.C. 154(b) by 0 days.

(21) Appl. No.: 09/910,250

(22) Filed: Jul. 20, 2001

(51) Int. Cl.[7] ..... A47B 7/00
(52) U.S. Cl. ..... 108/91; 108/92; 108/94
(58) Field of Search ..... 108/94, 95, 96, 108/92, 91, 93

(56) References Cited

U.S. PATENT DOCUMENTS

| | | | | |
|---|---|---|---|---|
| 23,079 | A | * | 2/1859 | Hermann |
| 1,155,638 | A | * | 10/1915 | Bowen |
| 2,082,236 | A | * | 6/1937 | Anderson |
| 3,047,348 | A | | 7/1962 | Hickox |
| 3,325,830 | A | | 6/1967 | Black |
| 3,347,186 | A | | 10/1967 | Khattar |
| D213,599 | S | | 3/1969 | Rye |
| 3,538,862 | A | * | 11/1970 | Patriarca |
| D228,589 | S | | 10/1973 | Moretini |
| D244,075 | S | | 4/1977 | Imber et al. |
| D250,372 | S | | 11/1978 | Szabo et al. |
| D253,980 | S | | 1/1980 | Schriever |
| D262,169 | S | | 12/1981 | Sonder et al. |
| D284,339 | S | | 6/1986 | Berry |
| D284,340 | S | | 6/1986 | Berry, Jr. |
| 4,738,495 | A | * | 4/1988 | Mitts |
| 5,810,181 | A | * | 9/1998 | Emalfarb et al. |
| 6,003,452 | A | * | 12/1999 | Moore |
| 6,349,657 | B1 | * | 2/2002 | Wohlford |

* cited by examiner

*Primary Examiner*—Jose V. Chen

(57) ABSTRACT

A nesting table system for providing a space efficient table that can be configured for the users specific needs including a vertical support assembly which is substantially cylindrical; a plurality of table assemblies, each having a form of a circular section and being pivotally coupled to the vertical support assembly; and a plurality pairs of legs, each being couplable to an associated one of the plurality table assemblies.

15 Claims, 4 Drawing Sheets

NESTING TABLE SYSTEM

BACKGROUND OF THE INVENTION

1. Field of the Invention

The present invention relates to end tables and more particularly pertains to a new nesting table system for providing a space efficient nesting table that can be configured for the users specific needs.

2. Description of the Prior Art

The use of end tables is known in the prior art. More specifically, end tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,325,830; U.S. Pat. No. 3,347,186; U.S. Pat. No. Des. 244,075; U.S. Pat. No. Des. 284,339; U.S. Pat. No. Des. 253,980; U.S. Pat. No. 3,047,348; U.S. Pat. No. Des. 228,589; U.S. Pat. No. Des. 250,372; U.S. Pat. No. Des. 262,169; U.S. Pat. No. Des. 284,340; and U.S. Pat. No. Des. 213,599.

While these devices fulfill their respective, particular objectives and requirements, the aforementioned patents do not disclose a new nesting table system. The inventive device includes a vertical support assembly which is substantially cylindrical; a plurality of table assemblies, each having a form of a circular section and being pivotally coupled to the vertical support assembly; and a plurality pairs of legs, each being couplable to an associated one of said plurality table assemblies.

In these respects, the nesting table system according to the present invention substantially departs from the conventional concepts and designs of the prior art, and in so doing provides an apparatus primarily developed for the purpose of providing a space efficient nesting table that can be configured for the users specific needs.

SUMMARY OF THE INVENTION

In view of the foregoing disadvantages inherent in the known types of end tables now present in the prior art, the present invention provides a new nesting table system construction wherein the same can be utilized for providing a space efficient nesting table that can be configured for the users specific needs.

The general purpose of the present invention, which will be described subsequently in greater detail, is to provide a new nesting table system apparatus and method which has many of the advantages of the end tables mentioned heretofore and many novel features that result in a new nesting table system which is not anticipated, rendered obvious, suggested, or even implied by any of the prior art end tables, either alone or in any combination thereof.

To attain this, the present invention generally comprises a vertical support assembly which is substantially cylindrical; a plurality of table assemblies, each having a form of a circular section and being pivotally coupled to the vertical support assembly; and a plurality pairs of legs, each being couplable to an associated one of said plurality table assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new nesting table system apparatus and method which has many of the advantages of the end tables mentioned heretofore and many novel features that result in a new nesting table system which is not anticipated, rendered obvious, suggested, or even implied by any of the prior art end tables, either alone or in any combination thereof.

It is another object of the present invention to provide a new nesting table system which may be easily and efficiently manufactured and marketed.

It is a further object of the present invention to provide a new nesting table system which is of a durable and reliable construction.

An even further object of the present invention is to provide a new nesting table system which is susceptible of a low cost of manufacture with regard to both materials and labor, and which accordingly is then susceptible of low prices of sale to the consuming public, thereby making such nesting table system economically available to the buying public.

Still yet another object of the present invention is to provide a new nesting table system which provides in the apparatuses and methods of the prior art some of the advantages thereof, while simultaneously overcoming some of the disadvantages normally associated therewith.

Still another object of the present invention is to provide a new nesting table system for providing a space efficient nesting table that can be configured for the users specific needs.

Yet another object of the present invention is to provide a new nesting table system which includes a vertical support assembly which is substantially cylindrical; a plurality of table assemblies, each having a form of a circular section and being pivotally coupled to the vertical support assembly;

and a plurality pairs of legs, each being couplable to an associated one of said plurality table assemblies.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
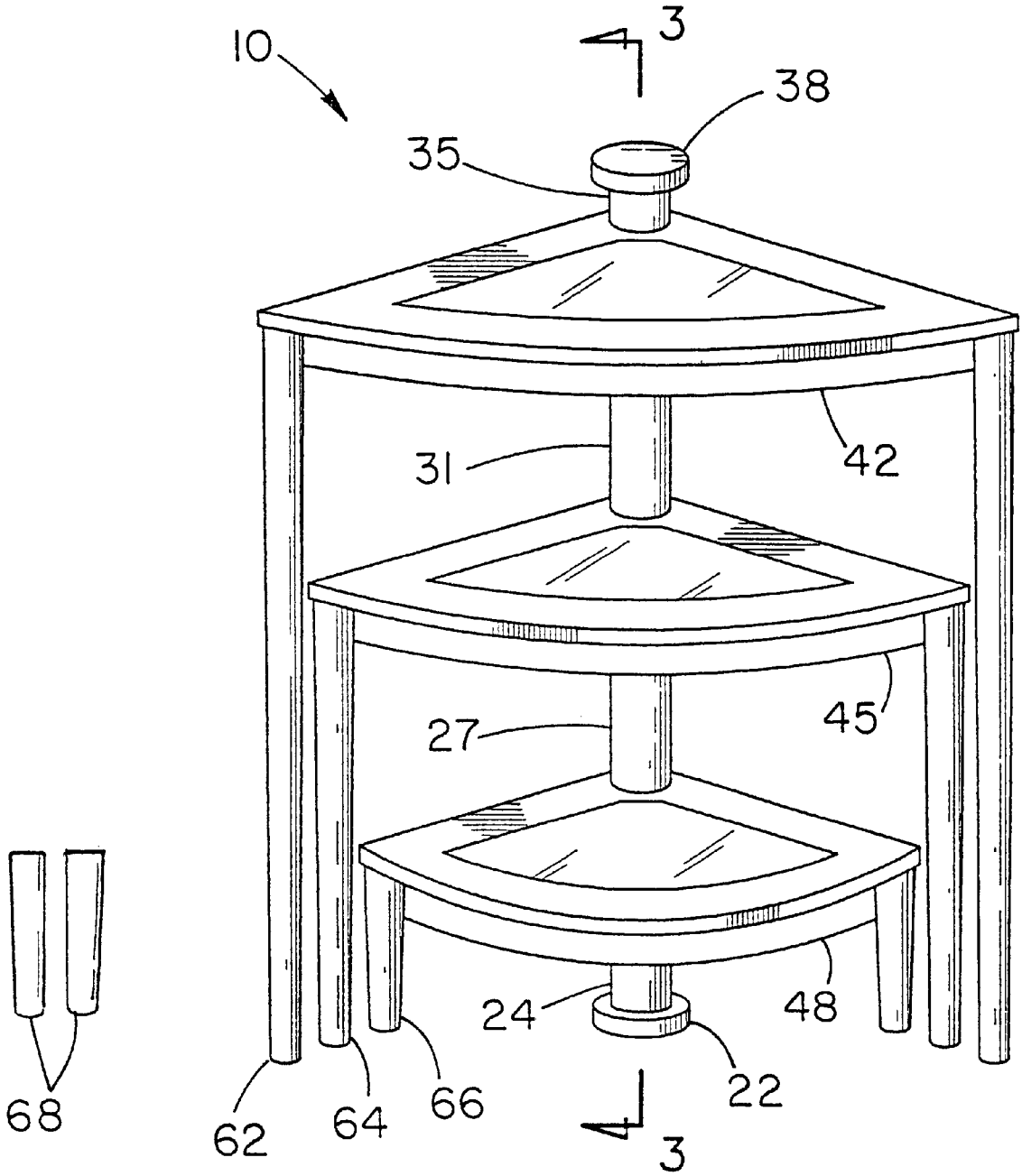
FIG. 1 is a schematic perspective view of a new nesting table system according to the present invention.
Figure 2:
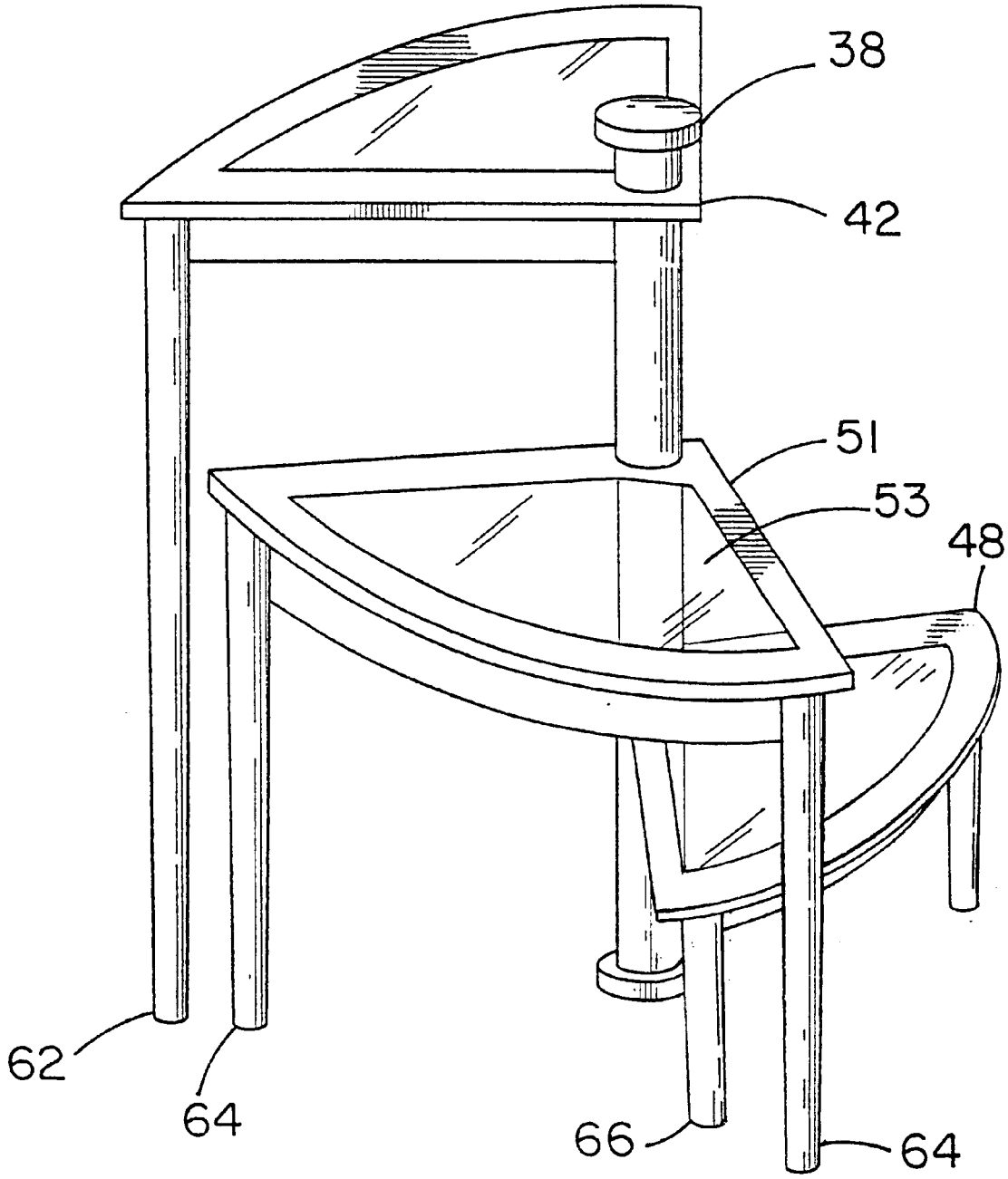
FIG. 2 is a schematic perspective view of the present invention in an expanded position.
Figure 3:
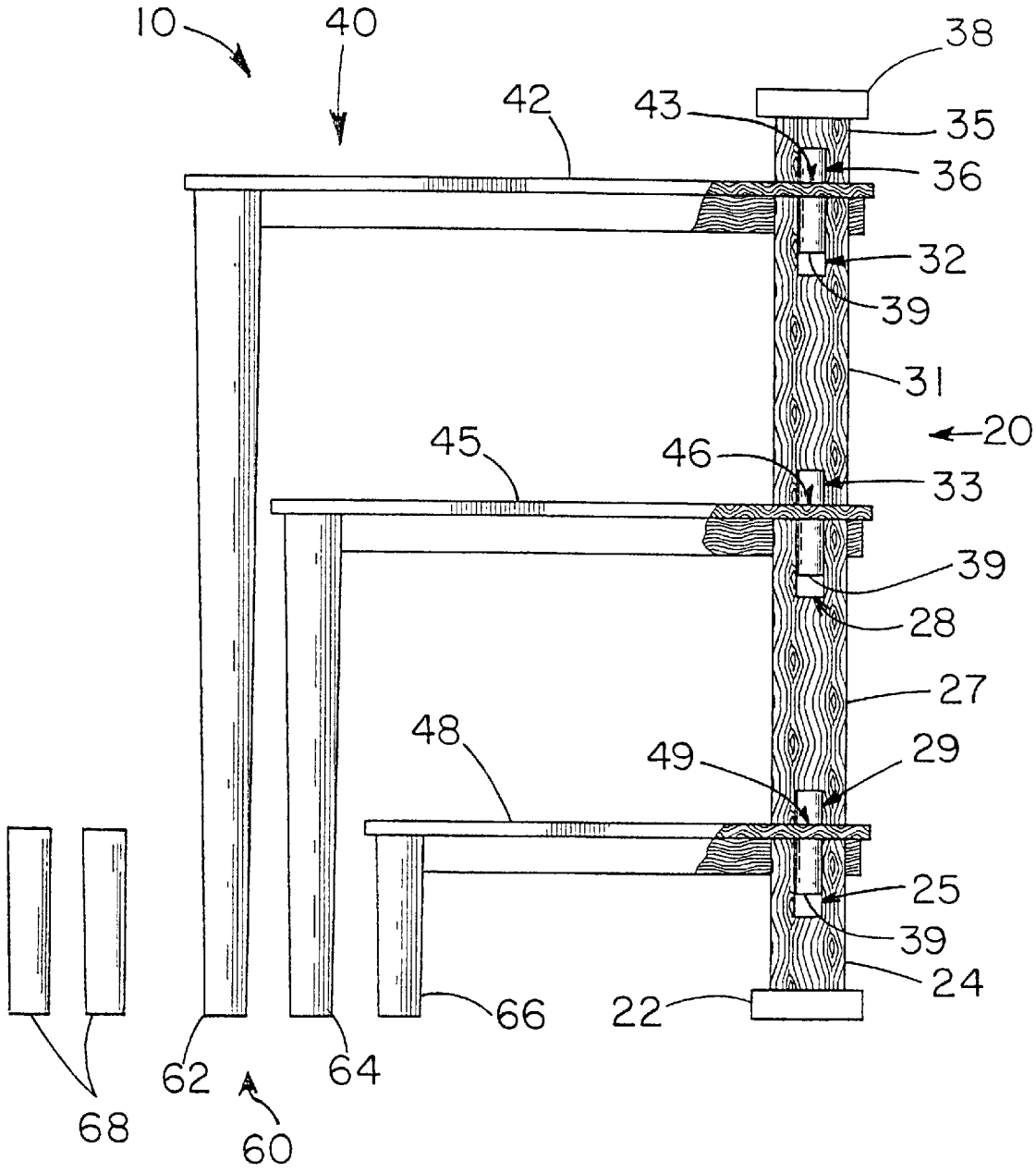
FIG. 3 is a schematic side view of the present invention.
Figure 4:
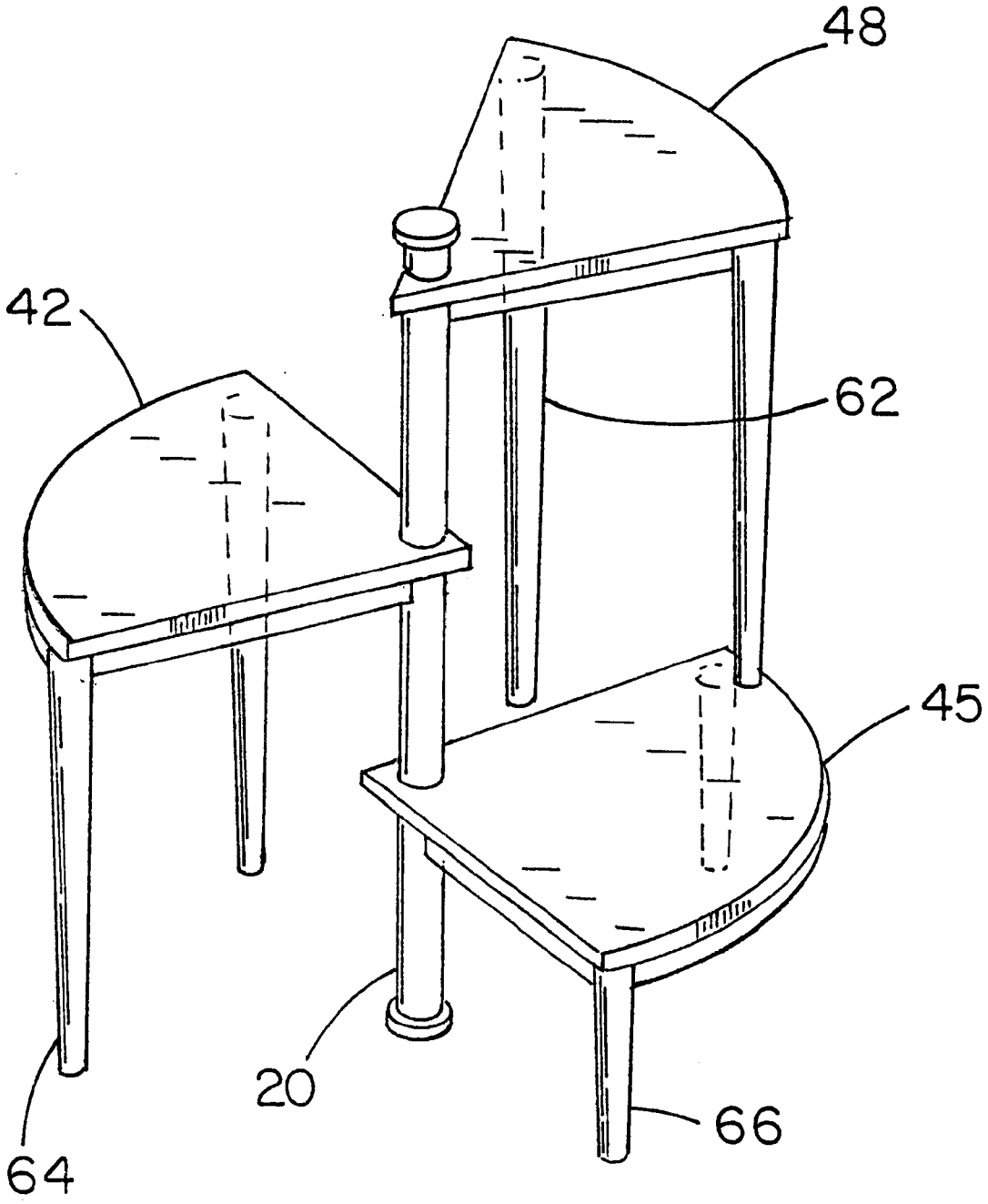
FIG. 4 is a schematic perspective view of the present invention, using the fourth pair of legs.

With reference now to the drawings, and in particular to FIGS. 1 through 4 thereof, a new nesting table system embodying the principles and concepts of the present invention and generally designated by the reference numeral 10 will be described.

As best illustrated in FIGS. 1 through 4, the nesting table system 10 generally comprises a vertical support assembly 20, a plurality of table assemblies 40, and a plurality of pairs of legs 60.

Each one of the plurality of table assemblies 40 includes a form of a circular section. Each one of the plurality of table assemblies 40 is pivotally coupled to the vertical support assembly 20, which is substantially cylindrical.

Each one of the plurality of pairs of legs 60 can be coupled to any of the plurality of table assemblies 40. The plurality of table assemblies 40 further comprising a first table assembly 42, a second table assembly 45, and a third table assembly 48. The first table assembly 42 is a first circular sector 42 with a radius of approximately 24 inches. The first circular sector 42 includes an aperture 43, which is positioned substantially adjacent to a focus of the first circular sector 42.

The second table assembly 45 is a second circular sector 45 with a radius of approximately 21 ½ inches. The second circular sector 45 also includes an aperture 46 positioned substantially adjacent to a focus of the second circular sector 45.

The third table assembly 48 further comprises a third circular sector 48, which includes a radius of approximately 19 inches. The third circular sector 48 includes an aperture 49, which is positioned substantially adjacent to a focus of the third circular sector 48.

The vertical support assembly 20 further comprises a base member 22, first 24, second 27, third 31 and fourth vertical support member 35, and a cap member 38. The base member 22 is designed for resting on a horizontal support surface such as a floor.

The first vertical standard 24 is substantially cylindrical. The first vertical standard 24 is coupled to the base member 22. The first vertical standard 24 is positioned such that a longitudinal axis of the first vertical standard 24 is substantially aligned with a longitudinal axis of the base member 22. The first vertical standard 24 includes a first bore 25, which extends downward from a top surface. The first bore 25 is positioned such that a longitudinal axis of the first bore 25 aligns with a longitudinal axis of the first vertical standard 24.

The second vertical standard 27 is substantially cylindrical. The second vertical standard 27 includes a diameter approximately equal to a diameter of the first vertical standard 24. The second vertical standard 27 includes a second bore 28, which extends downward from a top surface. The second bore 28 is positioned such that a longitudinal axis of the second bore 28 aligns with a longitudinal axis of the second vertical standard 27. The second vertical standard 27 includes a third bore 29, which extends upwardly from a bottom surface. The third bore 29 is positioned such that a longitudinal axis of the third bore 29 aligns with a longitudinal axis of the second vertical standard 27.

The third vertical standard 31 is also substantially cylindrical. The third vertical standard 31 includes a diameter approximately equal to a diameter of the first vertical standard 24. The third vertical standard 31 includes a fourth bore 32, which extends downward from a top surface. The fourth bore 32 is positioned such that a longitudinal axis of the fourth bore 32 aligns with a longitudinal axis of the third vertical standard 31. The third vertical standard 31 includes a fifth bore 33 extending upwardly from a bottom surface. The fifth bore 33 is positioned such that a longitudinal axis of the fifth bore 33 aligns with a longitudinal axis of the third vertical standard 31.

The fourth vertical standard 35 is substantially cylindrical. The fourth vertical standard 35 includes a diameter approximately equal to a diameter of the first vertical standard 24. The fourth vertical standard 35 includes a sixth bore 36 extending upwardly from a bottom surface. The sixth bore 36 is positioned such that a longitudinal axis of the sixth bore 36 aligns with a longitudinal axis of the fourth vertical standard 35.

The cap member 38 is positioned such that a longitudinal axis of the cap member 38 aligns with a longitudinal axis of the fourth vertical standard 35.

The vertical support assembly 20 also includes a plurality of pin members 39. Each one of the pin members 39 can be positioned in an associated pairing of bores. Each pin member 39 is for coupling an associated pairing of vertical standards, and for pivotally securing an associated one of the first 42, second 45, or third table assemblies 48 to the vertical support assembly 20.

The plurality of leg pairs 60 further comprises a first 62, second 64, and third pair of leg members 66. The first pair of leg members 62 is selectively couplable to each of the first 42, second 45, or third table assemblies 48. Each one of the first pair of leg members 62 includes a length of approximately 10 inches. The first pair of leg members 62 is used to support a forward portion of the selected first 42, second 45, or third table assemblies 48.

Similarly, the second pair of leg members 64 is also selectively couplable to each of the first 42, second 45, or third table assemblies 48. Each one of the second pair of leg members 64 includes a length of approximately 20 ¾ inches. The second pair of leg members 64 is used to support a forward portion of the first 42, second 45, or third table assemblies 48.

The third pair of leg members 66 is selectively couplable to each of the first 42, second 45, or third table assemblies 48. Each one of the third pair of leg members 66 includes a length of approximately 31 ½ inches. The third pair of leg members 66 is used to support a forward portion of the first 42, second 45, or third table assemblies 48.

In an embodiment the plurality of leg pairs 60 further comprises a forth pair of leg members 68. Similar to the first 62, second 64, and third pair of leg members 66, the fourth pair of leg members 68 is also selectively couplable to each of the first 42, second 45, or third table assemblies 48. Each one of the fourth pair of leg members 68 includes a length of approximately 10 inches. The fourth pair of leg members 68 is used to support a forward portion of the first 42, second 45, or third table assemblies 48. The forth pair of leg members 68 allows the first 42, second 45, and third table assemblies 48 to be positioned in any vertical order with respect to the vertical support assembly 20, as each of the vertical positions is approximately 10 inches above or below the adjacent vertical position.

In a further embodiment each of the plurality of table assemblies 40 further comprises a perimeter portion 51 and a panel portion 53. The perimeter portion 51 defines two sides and a front portion of the table assembly 40. The panel portion 53 is coupled to the perimeter portion 51. The perimeter portion 51 provides a top surface for each of the table assemblies 40.

In yet a further embodiment each one of the plurality of table assemblies 40 includes a panel portion 53 comprising a material selected from the group consisting of wood, glass, polymer, and metal.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A nesting table system comprising:

a vertical support assembly, said vertical support assembly being substantially cylindrical;

a plurality of table assemblies, each one of said plurality of table assemblies having a form of a circular section, each one of said plurality of table assemblies being pivotally coupled to said vertical support assembly;

a plurality pairs of legs, each pair of legs being couplable to an associated one of said plurality of table assemblies;

a first table assembly;

a second table assembly having a radius substantially less than a radius of said first table assembly;

a third table assembly having radius substantially less than a radius of said second table assembly;

wherein said vertical support assembly further comprises:

a base member, said base member being adapted for resting on a horizontal support surface such as a floor;

a first vertical standard, said first vertical standard being substantially cylindrical, said first vertical standard being coupled to said base member, said first vertical standard being positioned such that a longitudinal axis of said first vertical standard being substantially aligned with a longitudinal axis of said base member, said first vertical standard having a first bore extending downward from a top surface, said first bore being positioned such that a longitudinal axis of said first bore aligns with a longitudinal axis of said first vertical standard;

a second vertical standard, said second vertical standard being substantially cylindrical, said second vertical standard having a diameter approximately equal to a diameter of said first vertical standard, said second vertical standard having a second bore extending downward from a top surface, said second bore being positioned such that a longitudinal axis of said second bore aligns with a longitudinal axis of said second vertical standard; said second vertical standard having a third bore extending upwardly from a bottom surface, said third bore being positioned such that a longitudinal axis of said third bore aligns with a longitudinal axis of said first vertical standard;

a third vertical standard, said third vertical standard being substantially cylindrical, said third vertical standard having a diameter approximately equal to a diameter of said first vertical standard, said third vertical standard having a fourth bore extending downward from a top surface, said fourth bore being positioned such that a longitudinal axis of said fourth bore aligns with a longitudinal axis of said third vertical standard; said third vertical standard having a fifth bore extending upwardly from a bottom surface, said fifth bore being positioned such that a longitudinal axis of said fifth bore aligns with a longitudinal axis of said third vertical standard;

a fourth vertical standard, said fourth vertical standard being substantially cylindrical, said fourth vertical standard having a diameter approximately equal to a diameter of said first vertical standard, said fourth vertical standard having a sixth bore extending upwardly from a bottom surface, said sixth bore being positioned such that a longitudinal axis of said sixth bore aligns with a longitudinal axis of said fourth vertical standard;

a cap member, said cap member being positioned such that a longitudinal axis of said cap member aligns with a longitudinal axis of said fourth vertical standard.

2. The nesting table system of claim 1, wherein said first table assembly further comprises:

a first circular sector having a radius of approximately 24 inches, said first circular sector having an aperture therethrough, said aperture being positioned substantially adjacent to a focus of said first circular sector.

3. The nesting table system of claim 1, wherein said second table assembly further comprises:

a second circular sector having a radius of approximately 21 ½ inches, said second circular sector having an aperture therethrough, said aperture being positioned substantially adjacent to a focus of said second circular sector.

4. The nesting table system of claim 1, wherein said third table assembly further comprises:

a third circular sector having a radius of approximately 19 inches, said third circular sector having an aperture therethrough, said aperture being positioned substantially adjacent to a focus of said third circular sector.

5. The nesting table assembly of claim 1, wherein said vertical support assembly further comprises:

a plurality of pin members, each one of said pin members being positionable in an associated pairing of bores, each pin member being for coupling an associated pairing of vertical standards, each pin member being for pivotally securing an associated one of said first, second, or third table assemblies to said vertical support assembly.

6. A nesting table system comprising:

a vertical support assembly, said vertical support assembly being substantially cylindrical;

a plurality of table assemblies, each one of said plurality of table assemblies having a form of a circular section, each one of said plurality of table assemblies being pivotally coupled to said vertical support assembly;

a plurality pairs of legs, each pair of legs being couplable to an associated one of said plurality of table assemblies;

a first table assembly;

a second table assembly having a radius substantially less than a radius of said first table assembly;

a third table assembly having radius substantially less than a radius of said second table assembly;

wherein said plurality of leg pairs further comprises:

a first pair of leg members, said first pair of leg members being selectively couplable to each of said first, second, or third table assemblies; each one of said first pair of leg members having a length of approximately 10 inches, said first pair of leg members being used to support a forward portion of said first, second, or third table assemblies;

a second pair of leg members, said second pair of leg members being selectively couplable to each of said first, second, or third table assemblies; each one of said second pair of leg members having a length of approximately 20 ¾ inches, said second pair of leg members being used to support a forward portion of said first, second, or third table assemblies;

a third pair of leg members, said third pair of leg members being selectively couplable to each of said first, second, or third table assemblies; each one of said third pair of leg members having a length of approximately 31 ½ inches, said third pair of leg members being used to support a forward portion of said first, second, or third table assemblies.

7. The nesting table system of claim 6, wherein said first table assembly further comprises:

a first circular sector having a radius of approximately 24 inches, said first circular sector having an aperture therethrough, said aperture being positioned substantially adjacent to a focus of said first circular sector.

8. The nesting table system of claim 6, wherein said second table assembly further comprises:

a second circular sector having a radius of approximately 21 ½ inches, said second circular sector having an aperture therethrough, said aperture being positioned substantially adjacent to a focus of said second circular sector.

9. The nesting table system of claim 6, wherein said third table assembly further comprises:

a third circular sector having a radius of approximately 19 inches, said third circular sector having an aperture therethrough, said aperture being positioned substantially adjacent to a focus of said third circular sector.

10. A nesting table system comprising:

a vertical support assembly, said vertical support assembly being substantially cylindrical;

a plurality of table assemblies, each one of said plurality of table assemblies having a form of a circular section, each one of said plurality of table assemblies being pivotally coupled to said vertical support assembly;

a plurality pairs of legs, each pair of legs being couplable to an associated one of said plurality of table assemblies;

said plurality of table assemblies further comprising:

a first table assembly;

a second table assembly having a radius substantially less than a radius of said first table assembly;

a third table assembly having radius substantially less than a radius of said second table assembly;

said first table assembly further comprises a first circular sector having a radius of approximately 24 inches, said first circular sector having an aperture therethrough, said aperture being positioned substantially adjacent to a focus of said first circular sector;

said second table assembly further comprises a second circular sector having a radius of approximately 21 ½ inches, said second circular sector having an aperture therethrough, said aperture being positioned substantially adjacent to a focus of said second circular sector;

said third table assembly further comprises a third circular sector having a radius of approximately 19 inches, said third circular sector having an aperture therethrough, said aperture being positioned substantially adjacent to a focus of said third circular sector;

said vertical support assembly further comprises:

a base member, said base member being adapted for resting on a horizontal support surface such as a floor;

a first vertical standard, said first vertical standard being substantially cylindrical, said first vertical standard being coupled to said base member, said first vertical standard being positioned such that a longitudinal axis of said first vertical standard being substantially aligned with a longitudinal axis of said base member, said first vertical standard having a first bore extending downward from a top surface, said first bore being positioned such that a longitudinal axis of said first bore aligns with a longitudinal axis of said first vertical standard;

a second vertical standard, said second vertical standard being substantially cylindrical, said second vertical standard having a diameter approximately equal to a diameter of said first vertical standard, said second vertical standard having a second bore extending downward from a top surface, said second bore being positioned such that a longitudinal axis of said second bore aligns with a longitudinal axis of said second vertical standard;

said second vertical standard having a third bore extending upwardly from a bottom surface, said third bore being positioned such that a longitudinal axis of said third bore aligns with a longitudinal axis of said first vertical standard;

a third vertical standard, said third vertical standard being substantially cylindrical, said third vertical standard having a diameter approximately equal to a diameter of said first vertical standard, said third vertical standard having a fourth bore extending downward from a top surface, said fourth bore being positioned such that a longitudinal axis of said fourth bore aligns with a longitudinal axis of said third vertical standard; said third vertical standard having a fifth bore extending upwardly from a bottom surface, said fifth bore being positioned such that a longitudinal axis of said fifth bore aligns with a longitudinal axis of said third vertical standard;

a fourth vertical standard, said fourth vertical standard being substantially cylindrical, said fourth vertical standard having a diameter approximately equal to a diameter of said first vertical standard, said fourth vertical standard having a sixth bore extending upwardly from a bottom surface, said sixth bore being positioned such that a longitudinal axis of said sixth bore aligns with a longitudinal axis of said fourth vertical standard;

a cap member, said cap member being positioned such that a longitudinal axis of said cap member aligns with a longitudinal axis of said fourth vertical standard;

a plurality of pin members, each one of said pin members being positionable in an associated pairing of bores, each pin member being for coupling an associated pairing of vertical standards, each pin member being for pivotally securing an associated one of said first, second, or third table assemblies to said vertical support assembly; and said plurality of leg pairs further comprises:

a first pair of leg members, said first pair of leg members being selectively couplable to each of said first, second, or third table assemblies; each one of said first pair of leg members having a length of approximately 10 inches, said first pair of leg members being used to support a forward portion of said first, second, or third table assemblies;

a second pair of leg members, said second pair of leg members being selectively couplable to each of said first, second, or third table assemblies; each one of said second pair of leg members having a length of approximately 20 ¾ inches, said second pair of leg members being used to support a forward portion of said first, second, or third table assemblies;

a third pair of leg members, said third pair of leg members being selectively couplable to each of said first, second, or third table assemblies; each one of said third pair of leg members having a length of approximately 31 ½ inches, said third pair of leg members being used to support a forward portion of said first, second, or third table assemblies.

11. The nesting table assembly of claim 10, wherein said plurality of leg pairs further comprises:

a forth pair of leg members, said fourth pair of leg members being selectively couplable to each of said first, second, or third table assemblies; each one of said fourth pair of leg members having a length of approximately 10 inches, said fourth pair of leg members being used to support a forward portion of said first, second or third table assemblies, said forth pair of leg members allowing said first, second, and third to be positioned in any vertical order with respect to said vertical support assembly.

12. The nesting table assembly of claim 11, wherein each of said plurality of table assemblies further comprises:

a perimeter portion defining two sides and a front portion of said table assembly;

a panel portion coupled to said perimeter portion, said perimeter portion providing a surface for said table assembly.

13. The nesting table assembly of claim 12, wherein said panel portion comprises glass.

14. The nesting table assembly of claim 12, wherein said panel portion comprises wood.

15. The nesting table assembly of claim 12, wherein each one of said plurality of table assemblies having a panel portion comprising a material selected from the group consisting of wood, glass, polymer, and metal.

* * * * *